United States Patent [19]

Dennison

[11] Patent Number: 4,710,740

[45] Date of Patent: Dec. 1, 1987

[54] ELECTROMAGNETIC OPERATOR FOR A CONTACTOR WITH IMPROVED SHOCK PAD

[75] Inventor: William G. Dennison, Cedarburg, Wis.

[73] Assignee: Eaton Corporation, Cleveland, Ohio

[21] Appl. No.: 4,522

[22] Filed: Jan. 20, 1987

[51] Int. Cl.[4] ..... H01F 7/12

[52] U.S. Cl. ..... 335/248; 335/257; 335/277; 335/132

[58] Field of Search ..... 335/248, 257, 277, 131, 335/132, 133, 46, 202

[56] References Cited

U.S. PATENT DOCUMENTS

| | | | |
|---|---|---|---|
| 2,671,187 | 3/1954 | Jencks | 335/257 |
| 3,060,355 | 10/1962 | Kruzic | 335/277 |
| 3,195,024 | 7/1965 | Conrath | 335/257 |
| 3,469,215 | 9/1969 | Brovedan | 335/132 |
| 3,501,724 | 3/1970 | Westphal | 335/248 |
| 4,087,770 | 5/1978 | Kuhn et al. | 335/132 |
| 4,525,694 | 6/1985 | Dennison et al. | 335/132 |

*Primary Examiner*—E. A. Goldberg
*Assistant Examiner*—Lincoln Donovan
*Attorney, Agent, or Firm*—D. A. Rowe; L. G. Vande Zande

[57] ABSTRACT

An electromagnetic operator for a contactor (2) having a housing (4,34) including an insulating upper part (4) and a snap-in lower part (34), a magnetic armature (24) movable in the upper part (4), and a magnetic core (30), molded coil (28), return spring (36) and shock pad (32) in the lower part (34). The molded coil (28) is clamped immovably by the lower part (34) against the upper part (4) of the housing. The shock pad (32) has a flat base (32*a*) with a thin spherical segment (32*b*) between the magnet core (30) and the lower part (34) and four tabs (32*c-f*) at its corners supporting the four legs (28*c-d*) of the molded coil (28) to press the latter securely against the upper part (4) of the housing, these legs (28*c-d*) having reduced sections (28*e-f*) that sink into those tabs (32*c-f*). The shock pad (32) also has two pairs of resilient strips (32*g,h,j,k*) that extend from the opposite edges of the base (32*a*) up and toward one another between the yoke portions (32*c,d*) of the magnetic core (30) and the coil (28). This shock pad (32) takes up tolerances and isolates the magnetic core (30) for limited rocking movement in any radial direction to enable it to seat fully against the armature (24) when the coil (28) is energized. Alternatively, the resilient strips (32*c-f*) may be two continuous bands that can be stretched to assemble the shock pad (32) on the E-shaped magnetic core.

10 Claims, 4 Drawing Figures

ELECTROMAGNETIC OPERATOR FOR A CONTACTOR WITH IMPROVED SHOCK PAD

BACKGROUND OF THE INVENTION

Electromagnetic operators for contactors or the like have been provided with various types of shock pads heretofore. For example, Z. J. Kruzic U.S. Pat. No. 3,060,355, dated Oct. 23, 1962, shows a relay magnet suspension structure that includes an arcuate ridge in the shape of a relatively small segment of a cylinder as an integral part of the bottom of the housing and a flat rectangular strip of elastomeric material such as fiberboard or pressboard or paper cardboard or hard rubber or neoprene or other equivalent somewhat resilient material between such arcuate ridge and the magnet core, and a pair of helical compression springs that urge or bias the magnet core downwardly against the bottom of the housing. Also, A. Brovedan U.S. Pat. No. 3,469,215, dated Sept. 23, 1969, shows an electromagnetic relay having two cushion pads between the bottom of the housing and the magnetic core and between the magnetic core and the coil. These prior devices have been handicapped in that they have been rather complex in structure and have not performed all the functions desired of them. Accordingly, it has been found desirable to provide an improved shock pad for an electromagnetic operator for a contactor or the like that performs the improved functions hereinafter described.

SUMMARY OF THE INVENTION

An object of the invention is to provide an electromagnetic operator for a contactor or the like with an improved shock pad.

A more specific object of the invention is to provide an improved shock pad of the aforementioned type that completely isolates the magnetic core so that it is free to float a limited amount so as to isolate any vibration.

Another specific object of the invention is to provide an improved shock pad of the aforementioned type that enables the armature to settle flat against the pole faces when the coil is energized.

Another specific object of the invention is to provide an improved electromagnetic operator for a contactor or the like with a shock pad that will take up tolerances to avoid having to make the parts to exact dimensions.

Another specific object of the invention is to provide an electromagnetic operator for a contactor or the like with an improved shock pad having bands that serve a double purpose, that is, not only to retain the pad on the magnet frame in assembly but also to serve as a pad between the magnet core and the coil.

Another specific object of the invention is to provide an electromagnetic operator for a contactor with an improved shock pad that is simple in design and easy to assemble.

Other objects and advantages of the invention will hereinafter appear.

DESCRIPTION OF THE PREFERRED EMBODIMENT

Figure 1:
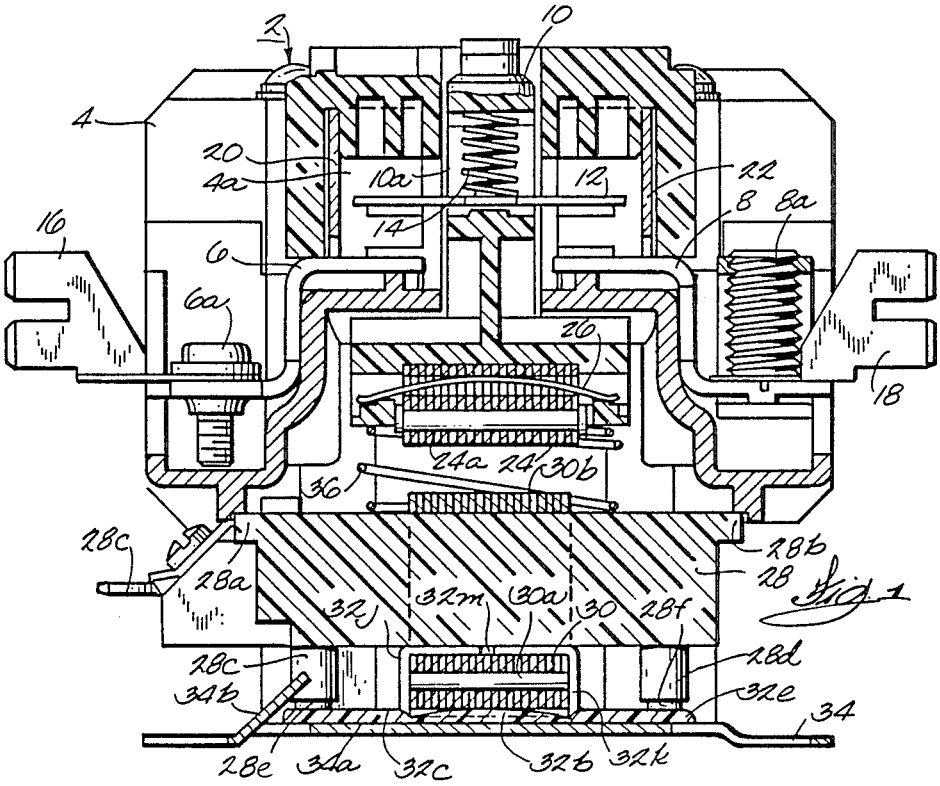
FIG. 1 is a cross sectional view of a contactor including an electromagnetic operator therefor showing the improved shock pad assembled therein according to the invention.

Referring to FIG. 1, there is shown a contactor 2 of the three pole type or the like constructed in accordance with the invention. As shown therein, the contactor is provided with a molded insulating housing 4 having an upwardly extending contact compartment 4*a* therein. For a three pole contactor of the type illustrated in FIG. 1, there will be three pairs of stationary contacts, stationary contacts 6 and 8 of the first pair being shown in FIG. 1, one stationary contact such as 6 of each pair extending from the left side of the housing into the contact compartment and the other contact such as 8 of each pair extending from the right side of the housing into the contact compartment. These stationary contacts such as 6 and 8 are press fitted into slots in the housing so that they are rigidly held in their positions.

A molded insulating contact carrier 10 is slidably accommodated within contact compartment 4*a* in the housing and has complementary sides with the inner walls of the contact compartment in the housing so that it can be vertically reciprocated under the force of an electromagnet and return spring hereinafter described. Contact carrier 10 is provided with a window such as 10*a* for each of three movable contacts such as 12 for retaining the movable bridging contacts on the contact carrier. A compression spring such as 14 resiliently maintains the movable contacts at the bottom of the associated windows to provide resilient contact pressure when the contacts are closed. The stationary contacts may be provided with suitable screw terminals 6*a*, lug terminals 8*a* or quick connect terminals 16 and 18. U-shaped arc blowout members 20 and 22 are inserted in slots in housing 4, there being one on the back, left and front sides of stationary contact 6 and movable contact 12 and another on the back, right and front sides of stationary contact 8 and movable contact 12. These arc blowout members 20 and 22 are made of magnetic material such as steel or the like. An armature 24 made of laminated magnetic plates held together by rivets 24*a* is mounted at the lower end of contact carrier 10 by a leaf spring 26. An operating coil 28 encapsulated in plastic material abuts housing 4 at its left and right sides 28*a* and 28*b* as shown in FIG. 1. An E-shaped magnetic frame or core 30 made of laminated magnetic material such as steel and held together by rivets 30*a* has a center pole 30*b* shown in FIGS. 1 and 4 that extends through the middle of the coil into the vacinity of armature 24 but spaced therefrom when the coil is not energized. The other two end poles of magnetic core 30 extend toward the armature on opposite sides of coil 28. For a more detailed illustration and description of a contactor of this general type but differing in certain respects as described herein, reference may be had to W. G. Dennison et al U.S. Pat. No. 4,525,694, dated June 25, 1985, which is incorporated herein by reference. Coil 28 is provided with a pair of terminals, one terminal 28*c* of which is shown in FIG. 1, these two terminals being connected to opposite ends of the coil wire.

A shock pad 32 is assembled on magnetic core 30 as hereinafter described and a metal frame 34 is snap-in mounted onto housing 4, there being a helical compression spring 36 between coil 28 and armature 24 around center pole 30*b* of the magnet core. Metal frame 34 is generally U-shaped as shown in the aforementioned patent and comprises a base plate 34*a*, a grounding tab 34*b* and four upstanding arms (not shown) having holes which snap onto complementary lugs integrally molded on the side walls of housing 4 in known manner to compress shock pad 32 and to hold coil 28, magnet core 30, shock pad 32 and return spring 36 in assembled relation as hereinafter more fully described.

Figure 2:
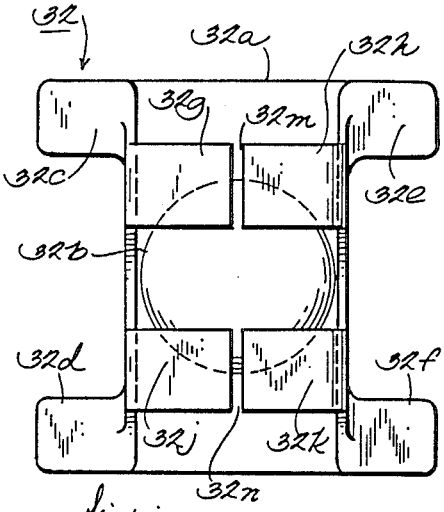
FIG. 2 an enlarged top view of the shock pad used in the contactor of FIG. 1.
Figure 3:
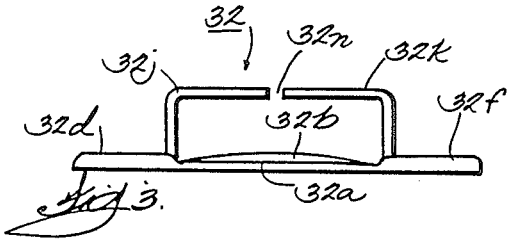
FIG. 3 is a side view of the shock pad of FIG. 2.

As shown in FIGS. 2 and 3, shock pad 32 which is made of silicone rubber or the like resilient material is provided with a generally flat base portion 32*a* having an integrally molded thin spherical segment 32*b* centrally on its upper surface and two pairs of tabs with tabs 32*c* and 32*d* extending toward the left from the left corners of base portion 32*a* and tabs 32*e* and 32*f* extending toward the right from the right corners of base portion 32*a*, these tabs or supporting pads being thicker than base portion 32*a* as shown in FIG. 3 for supporting the legs of the molded coil as hereinafter described. Shock pad 32 is also provided with either two pairs of integrally formed resilient strips 32*g*, 32*h* and 32*j*, 32*k* or two continuous bands as hereinafter described. As shown in FIGS. 2 and 3, strips 32*g* and 32*h* extend upwardly from opposite sides of base portion 32*a* adjacent tabs 32*c* and 32*e* and then toward one another leaving a small space 32*m* between the adjacent ends thereof. In a similar manner, integrally formed resilient strips 32*j* and 32*k* extend upwardly from opposite edges of base portion 32*a* adjacent tabs 32*d* and 32*f* and then toward one another leaving a small space 32*n* between the adjacent ends thereof.

Figure 4:
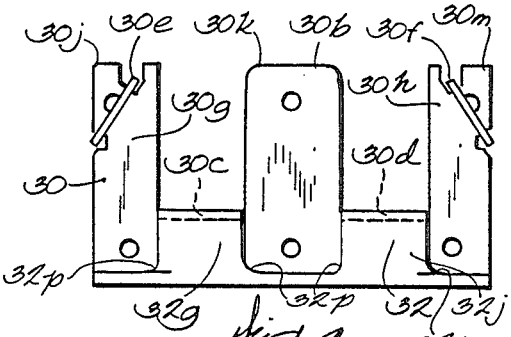
FIG. 4 is a side view of the magnetic core of the contactor of FIG. 1 showing the shock pad assembled thereon.

As shown in FIG. 4, shock pad 32 is assembled onto magnetic core 30 by separating strips 32*g* and 32*h* from one another and also separating strips 32*j* and 32*k* from one another and then placing the flat bottom of the magnetic core over spherical segment 32*b* and base portion 32*a* and allowing the strips to snap back in toward one another over yoke portions 30*c* and 30*d* of the magnet frame as shown in FIG. 4. With the shock pad being preformed or molded as shown in FIG. 3, after the resilient strips have been separated manually and the magnet frame placed over the shock pad, these resilient strips will naturally snap back over the yoke portions of the magnet frame to retain the shock pad on the magnet frame without any further attachment. As shown in FIG. 4, magnetic core 30 also has a pair of shading coils 30*e* and 30*f* on its outer arms for purposes known in the art.

As hereinbefore mentioned, alternatively, resilient strips 32*g* and 32*h* may be formed as a continuous band eliminating space 32*m* and strips 32*j* and 32*k* may be formed as a continuous band eliminating space 32*n*. To assembly this alternative construction of shock pad onto the magnetic core, one of the outer poles 30*g* or 30*h* is first inserted from the center beneath one band and then the other band is stretched and pulled over the other end pole. This shock pad is sufficiently resilient so that it will not tear when one or the other band is stretched in that manner to assemble it onto the magnetic core. To prevent such tearing, the corners such as 32*p* where the bands extend upwardly from base portion 32*a* are given a substantial radius as shown in FIG. 4. As shown in FIG. 1, when the contactor is fully assembled, the flat bottom surface of magnetic core 30 rests on spherical segment 32*b* of the shock pad and the flat bottom surface of coil 28 rests on strips 32*g*, 32*h*, 32*j* and 32*k* of the shock pad. Also, molded coil 28 is provided with four legs two of which legs 28*c* and 28*d* are shown in FIG. 1 and these legs which are rectangular in cross section are provided with reduced diameter cylindrical lower end portions such as 28*e* and 28*f* that press down on supporting pads 32*c*, 32*d*, 32*e* and 32*f* of shock pad 32. As a result, when frame 34 is snapin assembled onto housing 4, molded coil 28 securely abuts housing 4 along its end portions 28*a* and 28*b*, spring 36 is compressed to hold armature 24 and contact carrier 10 in normally open contact position as shown in FIG. 1, the round end portions such as 28*e* and 28*f* as well as similar round end portions on the other two similar legs of the coil sink into supporting pads or tabs 32*c*, 32*d* 32*e* and 32*f*, and spherical segment 32*b* as well as the upper portions of strips 32*g*, 32*h*, 32*j* and 32*k* are slightly compressed. As a result, coil 28 is held stationary but magnetic core 30 is resiliently isolated therefrom so that it is capable of tilting slightly in any radial direction thereby to insure that pole faces 30*j*, 30*k* and 30*m* of the three poles of the magnetic core will seat fully against the lower flat surfaces of the armature when the coil is energized.

While the apparatus hereinbefore described is effectively adapted to fulfill the objects stated, it is to be understood that the invention is not intended to be confined to the particular preferred embodiment of electromagnetic operator for a contactor with improved shock pad disclosed, inasmuch as it is susceptible of various modifications without departing from the scope of the appended claims.

I claim:

1. An electromagnetic operator for a contactor or the like having a two-part housing, a magnetic armature movably mounted in one part of said housing, a magnetic core having a plurality of pole pieces opposite said armature joined by a yoke portion and positioned in the other part of said housing, a coil encased in plastic molding material to provide a molded coil surrounding one of said pole pieces, and means clamping said two housing parts together whereby one of said housing parts forces the molded coil against the other housing part and supports said magnetic core between said one housing part and said molded coil, characterized by:

a shock pad taking up tolerances and confining said molded coil against movement relative to said housing while allowing limited radial rocking movement of said magnetic core so as to enable said armature to seat fully against said pole pieces upon energization of said coil comprising:

a resilient generally flat portion substantially coextensive with said magnetic core having at its center a shallow resilient spherical segment bump between said magnetic core and said other part of said housing allowing said limited radial rocking movement of said magnetic core;

resilient means extending up from opposite sides of said flat portion and over said yoke portion of said magnetic core between said yoke portion and said molded coil to allow said limited radial rocking movement of said magnetic core relative to said molded coil;

and a plurality of resilient supporting pads extending laterally in opposite directions from said flat portion providing supports between said molded coil and said other part of said housing;

and said molded coil having a plurality of legs pressed against said supporting pads by said clamping means to take up tolerances and to hold said molded coil relatively immovable with respect to said housing while at the same time enabling said clamping means to act through said spherical segment and said magnetic core to apply the desired lesser pressure on said resilient strip means between said coil and said magnetic core to allow said limited radial rocking movement of said magnetic core.

2. The electromagnetic operator claimed in claim 1, wherein;

said magnetic core is an E-shaped magnetic member having three spaced pole pieces with pole faces opposite said armature and joined by said yoke portion;

said molded coil surrounds the middle pole piece;

and said resilient means comprises:

a first integral resilient strip means extending up from opposite sides of said flat portion and over said yoke portion between said middle pole piece and one end pole piece;

and a second integral resilient strip means extending up from opposite sides of said flat portion and over the yoke portion between said middle pole piece and the other end pole piece.

3. The electromagnetic operator claimed in claim 1, wherein;

said resilient strip means extend only part-way over said yoke portion with a gap at the middle for facilitate assembly of said shock pad onto said magnetic core.

4. The electromagnetic operator claimed in claim 1, wherein:

said resilient supporting pads are thicker than said flat portion.

5. The electromagnetic operator claimed in claim 1, wherein:

said magnetic core is an E-shaped magnetic member having three spaced pole pieces with pole faces in a common plane opposite said armature and joined by said yoke portion;

said molded coil surrounds the middle pole piece;

and said resilient strip means comprise:

a first integral continuous band extending from one side of said flat portion over the yoke portion between said middle pole piece and one end pole piece to the other side of said flat portion of said shock pad;

a second integral continuous band extending from said one side of said flat portion over the yoke portion between said middle pole piece and the other end pole piece to said other side of said flat portion of said shock pad;

and said bands are sufficiently elastic to enable one end pole piece to be inserted under one of said bands and the other band to be stretched over the other end pole piece onto said magnetic core.

6. The electromagnetic operator claimed in claim 1, wherein:

said plurality of legs on said molded coil constitute four legs;

and said plurality of resilient supporting pads on said shock pad constitute four resilient supporting pads on which the respective four legs are pressed.

7. The electromagnetic operator claimed in claim 6, wherein:

each of said molded coil legs is provided at its lower end with a reduced cross-section portion pressing into the respective resilient supporting pad of said shock pad to take up tolerances.

8. The electromagnetic operator claimed in claim 1, wherein:

said shock pad is a one-piece unit molded of resilient material.

9. The electromagnetic operator claimed in claim 7, wherein:

said resilient material is silicone rubber.

10. In an electromagnetic operator for a contactor or the like having a two-part housing, a magnetic armature movably mounted in one part of said housing, an E-shaped magnetic core having three spaced parallel pole pieces including a middle pole piece and opposite end pole pieces joined by integral yoke portions therebetween with said pole pieces having pole faces in a common plane opposite said armature and positioned in the other part of said housing, a coil embedded in plastic molding material surrounding said middle pole piece, and means clamping said two housing parts together whereby one of said housing parts abuts said molded coil to force the same against said yoke portions and said molded coil in turn forces said magnetic core against the other housing part, the improvement comprising:

a shock pad of resilient material confining said molded coil against significant movement relative to said housing while allowing limited radial rocking movement of said magnetic core so as to enable said armature to seat fully against said pole faces upon energization of said coil comprising:

a generally flat portion substantially coextensive with the side of said magnetic core opposite said pole faces having an integral spherical segment against said magnetic core side;

strip means extending from said flat portion over said yoke portions of said magnetic core between said yoke portions and said molded coil to allow said limited radial rocking movement of said magnetic core relative to said molded coil;

a plurality of resilient supporting pads extending laterally from said flat portion providing resilient supports between said molded coil and said other part of said housing;

and said molded coil having a plurality of legs pressed against said resilient supporting pads by said clamping means to hold said molded coil relatively immovable with respect to said housing while at the same time enabling said clamping means to act through said flat portion and spherical segment and said magnetic core to apply the desired pressure on said resilient strip means between said coil and said magnetic core to allow said limited radial rocking movement of said magnetic core.

* * * * *